US010022931B2

(12) United States Patent
Thunholm et al.

(10) Patent No.: US 10,022,931 B2
(45) Date of Patent: Jul. 17, 2018

(54) ARRANGEMENT AND METHOD FOR HANDLING A LOAD FOR ISOSTATIC PRESSURE TREATMENT

(71) Applicant: Avure Technologies AB, Västerås (SE)

(72) Inventors: Roger Thunholm, Vasteras (SE); Asa Eriksson, Vasteras (SE); Anders Eklund, Vasteras (SE)

(73) Assignee: AVURE TECHNOLOGIES AB, Vasteras (SE)

( * ) Notice: Subject to any disclaimer, the term of this patent is extended or adjusted under 35 U.S.C. 154(b) by 757 days.

(21) Appl. No.: 14/435,879

(22) PCT Filed: Oct. 15, 2012

(86) PCT No.: PCT/EP2012/070436
§ 371 (c)(1),
(2) Date: Apr. 15, 2015

(87) PCT Pub. No.: WO2014/060017
PCT Pub. Date: Apr. 24, 2014

(65) Prior Publication Data
US 2015/0266253 A1 Sep. 24, 2015

(51) Int. Cl.
*B30B 11/00* (2006.01)
*B30B 15/02* (2006.01)
*B30B 15/30* (2006.01)

(52) U.S. Cl.
CPC ..... *B30B 15/028* (2013.01); *B30B 11/002* (2013.01); *B30B 15/30* (2013.01)

(58) Field of Classification Search
CPC ..... B30B 15/028; B30B 15/30; B30B 11/002
See application file for complete search history.

(56) References Cited

U.S. PATENT DOCUMENTS 3,111,100 A * 11/1963 Georgeff ..... B21D 37/04 100/224
3,550,199 A * 12/1970 Landa ..... B30B 11/001 100/214

(Continued)

FOREIGN PATENT DOCUMENTS

CN 2215487 Y 12/1995
CN 102476445 A 5/2012

(Continued)

OTHER PUBLICATIONS

Japanese Office Action and English translation thereof dated Sep. 6, 2016.

(Continued)

*Primary Examiner* — Sean Michalski
(74) *Attorney, Agent, or Firm* — Harness, Dickey & Pierce, P.L.C.

(57) ABSTRACT

There is provided an arrangement and a method for handling a load for isostatic pressure treatment in a high-pressure arrangement. The arrangement includes a transportation unit including at least one track for transporting the load into a treatment position for isostatic pressure treatment of the load from a working space outside the high-pressure arrangement. Furthermore, the transportation unit is further arranged for transporting the load from the treatment position to the working space after pressure treatment of the load. The arrangement further includes a partition plane arranged at least partially above the high-pressure arrangement, wherein the working space is provided above the partition plane. The partition plane is arranged to shield the working space from the high-pressure arrangement in the event of a gas leakage of the high-pressure arrangement.

19 Claims, 4 Drawing Sheets

(56) References Cited

U.S. PATENT DOCUMENTS

| | | | | |
|---|---|---|---|---|
| 3,893,852 | A * | 7/1975 | Bergman | B22F 3/15 419/49 |
| 4,155,476 | A | 5/1979 | Lipiec et al. | |
| 4,478,626 | A * | 10/1984 | Moritoki | B22F 3/15 264/570 |
| 4,484,881 | A | 11/1984 | Asari et al. | |
| 4,582,681 | A * | 4/1986 | Asari | B22F 3/15 264/517 |
| 4,630,536 | A * | 12/1986 | Shah | B30B 15/028 100/229 R |
| 4,756,680 | A | 7/1988 | Ishii | |
| 4,921,666 | A | 5/1990 | Ishii | |
| 4,923,381 | A * | 5/1990 | Delmer | B30B 11/004 425/185 |
| 5,100,602 | A | 3/1992 | Day et al. | |
| 6,592,694 | B1 * | 7/2003 | Willman | B30B 15/24 156/228 |
| 6,761,548 | B1 * | 7/2004 | Snop | B01J 3/048 264/570 |
| 7,008,210 | B2 * | 3/2006 | Manabe | F27D 7/04 425/185 |
| 8,506,284 | B2 * | 8/2013 | Bergman | B22F 3/15 425/405.2 |
| 2003/0197295 | A1 * | 10/2003 | Nakai | B22F 3/15 264/40.3 |
| 2012/0289388 | A1 * | 11/2012 | Ehrmann | B29C 33/30 483/1 |
| 2013/0316035 | A1 * | 11/2013 | Nishiyama | B21D 37/02 425/150 |
| 2013/0319264 | A1 * | 12/2013 | McLaughlin | B09B 3/00 100/345 |
| 2015/0165710 | A1 * | 6/2015 | Jang | B22F 3/04 425/405.2 |
| 2015/0174633 | A1 * | 6/2015 | Sato | B21D 5/004 483/1 |

FOREIGN PATENT DOCUMENTS

| | | | |
|---|---|---|---|
| DE | 4303283 | A1 | 8/1994 |
| EP | 0145417 | A2 | 6/1985 |
| EP | 1527815 | A1 | 5/2005 |
| FR | 2291023 | A1 | 6/1976 |
| JP | 58071301 | | 4/1983 |
| JP | 61253198 | | 11/1986 |
| JP | 6220795 | | 1/1987 |
| JP | 63197877 | | 8/1988 |
| JP | H01162598 | A | 6/1989 |
| JP | 02142699 | | 5/1990 |
| JP | H0276692 | U | 6/1990 |
| JP | 4981279 | B2 | 7/2012 |
| KR | 101155960 | B1 | 6/2012 |
| RU | 2037380 | C1 | 6/1995 |
| SU | 1585072 | A1 | 8/1990 |

OTHER PUBLICATIONS

Russian Office Action and English translation thereof dated Oct. 4, 2016.
Russian Search Resort dated Sep. 15, 2016.
Chinese Office Action dated Dec. 2, 2015.
International Search Report PCT/ISA/210 for International Application No. PCT/EP2012/070436 dated Jul. 25, 2013.
International Preliminary Report on Patentability for International Application No. PCT/EP2012/070436 dated Apr. 8, 2015.

* cited by examiner

ARRANGEMENT AND METHOD FOR HANDLING A LOAD FOR ISOSTATIC PRESSURE TREATMENT

CROSS REFERENCE TO RELATED APPLICATIONS

This is a National Phase Application of PCT/EP2012/070436 filed Oct. 15, 2012, the entire contents of which is hereby incorporated by reference.

FIELD OF THE INVENTION

The present invention relates to the field of high pressure treatment. In particular, the present invention relates to an arrangement for handling a load for isostatic pressure treatment. Also, the invention relates to a method for handling a load for high pressure treatment.

BACKGROUND OF THE INVENTION

Isostatic presses are used in producing different types of articles, such as turbine blades for aircraft or artificial hip joints for implantation into persons. The press usually comprises a furnace provided with electric heating elements for increasing the temperature in the furnace chamber where the load, i.e. the articles, is being pressed in a loading space. After a finished pressing operation it is often important to rapidly cool the loading space so that the load therein will obtain the desired properties and so that grain growth is avoided or minimized. Furthermore, a rapid cooling results in an increased productivity, as the load may be removed rapidly, thereby reducing the cycle time. However, it is also important that an even cooling throughout the loading space is achieved.

During a high-pressure pressing operation of a high-pressure press, a pressure medium, which is accommodated in a pressure chamber of a pressure vessel, is pressurized to a very high pressure. The pressure medium is often a fluid gaseous medium, e.g. argon gas. High-pressure presses can be used in various applications, e.g. in the forming of sheet metal parts into predetermined shapes by highly pressurizing a fluid provided in a closed container. If the high-pressure press exerts an equal pressure on every side of the contents in the pressure vessel, the press is called an isostatic press. Depending on the temperature of the pressure medium during an isostatic pressing process, the process can be called a hot isostatic pressing or a HIP (hereinafter referred to as HIP), warm isostatic pressing or cold isostatic pressing.

HIP has established itself in the past decades as a competitive and proven manufacturing process for the production of components made from a wide range of metals and/or ceramics, wherein the components are used in a number of industry sectors such as the aerospace, offshore, energy and medical sector. The gas pressure acts uniformly in all directions to provide isostatic properties and a very high degree of material densification. HIP provides many benefits and has become a viable and high performance alternative to conventional processes such as forging, casting and machining. The HIP technology may be used for the compaction of metal powders (powder metallurgy HIP or PM HIP) in a container. The powder is compressed through pressure while the temperature will ensure diffusion on the contact surface between powder grains, until hollow spaces are closed so that a very high densification is achieved. The PM HIP technology is advantageous in numerous aspects, e.g. in that it is able to offer improved material properties provided by the fine and homogenous isotropic microstructure, an improved wear and corrosion resistance through extended alloying possibilities, a reduction of the number of welding operations and associated cost and inspection issues, etc.

The HIP press is often arranged in a pit or a cavity at the work site. However, there are problems related to such an arrangement, as it may be hazardous in the event of a breakage of the high-pressure press. For example, a leakage of pressure medium gas (e.g. an asphyxiating gas such as Ar) of the high-pressure press may lead to a rapid increase of the gas concentration in the pit. This may be highly dangerous for a person present in the pit for reasons of maintenance and/or inspection of the high-pressure press. Although gauges for measuring the degree of asphyxiating gases within the press and in its surroundings need be provided, as well as special training for the staff handling the presses, these and other measures may not be enough for a safe operation of the high-pressure press. Furthermore, as the pit or cavity often is relatively narrow or tight, the space is strictly limited for various high-pressure press operations such as an insertion and/or removal of a pressure vessel into and/or out from the high-pressure press. This may result in a more inconvenient operation of the high-pressure press, especially before and after pressure treatment. Furthermore, it will be appreciated that the market continuously demands larger loads and/or a more efficient HIP productivity, which leads to even larger HIP arrangements with a need for an increased efficiency. However, many prior art arrangements are not able to offer larger HIP units due to the limitations of the known arrangements.

Hence, there is a wish for an alternative arrangement which alleviates at least some of the above-mentioned problems, and which is able to provide a safer and more convenient operation.

SUMMARY OF THE INVENTION

It is an object of the present invention to mitigate the above problems and to provide an arrangement which achieves a safe and convenient operation.

This and other objects are achieved by providing an arrangement and a method having the features defined in the independent claims. Preferred embodiments are defined in the dependent claims.

Hence, according to a first aspect of the present invention, there is provided an arrangement for handling a load for isostatic pressure treatment in a high-pressure arrangement. The arrangement comprises a transportation unit comprising at least one track for transporting the load into a treatment position for isostatic pressure treatment of the load from a working space outside the high-pressure arrangement. Furthermore, the transportation unit is further arranged for transporting the load from the treatment position to the working space after pressure treatment of the load. The arrangement further comprises a partition plane arranged at least partially above the high-pressure arrangement, wherein the working space is provided above the partition plane. The partition plane is arranged to shield the working space from the high-pressure arrangement in the event of a gas leakage of the high-pressure arrangement.

According to a second aspect of the present invention, there is provided a method for handling a load for isostatic pressure treatment in a high-pressure arrangement. The method comprises the steps of transporting a load on at least one track into a treatment position for isostatic pressure treatment of the load from a working space outside the high-pressure arrangement, and transporting the load from the treatment position to the working space after pressure treatment of the load. The method further comprises the step of providing a partition plane at least partially above the high-pressure arrangement, wherein the working space is provided above the partition plane. The method further comprises the step of shielding the working space from the high-pressure arrangement by means of the partition plane in the event of a gas leakage of the high-pressure arrangement.

Thus, the present invention is based on the idea of transporting a load into and out from a treatment position of a high-pressure arrangement for isostatic pressure treatment. The partition plane arranged at least partially above the high-pressure arrangement provides a space under the partition plane for a convenient transportation of a load, and optionally other equipment, into the high-pressure arrangement, and the partition plane furthermore provides a shielding of the working space from the high-pressure arrangement in the event of a gas leakage of the high-pressure arrangement.

The present invention is advantageous in that the partition plane provides a relatively spacious floor or space, such that a relatively large and/or long load (with or without auxiliary equipment) may be transported (horizontally) into and out from the high-pressure arrangement. In other words, the load and/or equipment may be conveniently transported on the track of the transportation unit in the space. This is highly advantageous in the case of relatively large loads and/or equipment which are needed to meet market demands of large loads and/or an efficient productivity.

The partition plane of the present invention is able to define a working space, i.e. an upper floor, above the partition plane, wherein the working space may be arranged for any kind of production operation, e.g. a handling of a load. Furthermore, the partition plane is able to define a space below the partition plane, i.e. a lower floor, wherein the space is arranged for the transportation of a load into the treatment position of the high-pressure arrangement. The (lower floor) space may further be arranged for any kind of maintenance operation. Hence, the partition plane achieves a convenient separation in the arrangement for an easy operation of the arrangement.

Another advantage of the present invention is that the arrangement may be provided in one or more modules, such that the arrangement is easily manufactured and installed. By the arrangement of the present invention, no pit or cavity is needed for the high-pressure arrangement, and no overhead crane needs to be provided for load transportation.

The present invention is further advantageous in that the arrangement allows for a modularisation of (auxiliary) equipment associated with the load. In other words, equipment provided for a load for pressure treatment may be provided as a module or unit (in advance). In prior art arrangements, e.g. when a cavity or pit is used for the high-pressure arrangement, there is often little or no space available for load-associated equipment, and there is hereby a need to provide pre-installed equipment at the site of the high-pressure arrangement. In the present invention, on the other hand, the equipment may be provided as a unitary arrangement or unit. This has the advantage that the equipment for the load may be assembled into a unit in advance, and that the unit provides a more convenient transport to the site of the high-pressure press.

The present invention is further advantageous in that the partition plane is able to shield the working space from the high-pressure arrangement in any breakage and/or malfunctioning of the high-pressure arrangement, such as a leakage of pressure medium (e.g. of argon gas), an explosion, etc. Hence, the partition plane is able to protect any persons and/or equipment provided above the partition plane from a (dangerous) leakage of gas beneath the partition floor.

The arrangement for handling a load for isostatic pressure treatment in a high-pressure arrangement comprises a transportation unit comprising at least one track. By "track", it is here meant substantially any kind of guiding means such as a rail, a line, or the like. The transportation unit (the track of the transportation unit) is arranged for transporting the load into a treatment position for isostatic pressure treatment of the load from a working space outside the high-pressure arrangement. By "treatment position", it is here meant a position wherein the load may be subjected to the pressure from the high-pressure arrangement during treatment. By "working space", it is here meant a space, a room, or the like wherein the load may be manually and/or automatically handled, stored, or the like. Analogously, the transportation unit (the track of the transportation unit) is arranged for transporting the load from the treatment position to the working space after pressure treatment of the load.

The arrangement further comprises a partition plane arranged at least partially above the high-pressure arrangement. By "partition plane", it is here meant a (horizontal) floor, wall or the like, at least partially separating the working space from the high-pressure arrangement. The partition plane is arranged to shield the working space from the high-pressure arrangement in the event of a gas leakage of the high-pressure arrangement or any other breakage of the high-pressure arrangement which could be hazardous for persons and/or equipment in the working space.

According to an embodiment of the present invention, the transportation unit may be configured to transport an equipment unit on the at least one track, wherein the equipment unit comprises one or more of the group consisting of a pressure vessel for holding a load for isostatic pressure treatment, a power transformer unit, a compressor unit. In other words, the transportation unit is able to transport one or more pieces of (auxiliary) equipment for the load to be treated. The present embodiment is advantageous in that the equipment may be provided as a (pre-assembled) module or unit. Prior art arrangements may often suffer from a lack of space in a close vicinity of the pressure press, and may be forced to provide any load-associated equipment separate from the load and/or to provide pre-installed equipment at the site of the high-pressure arrangement. In the present invention, on the other hand, the equipment may be provided as a unitary arrangement or unit, and the load and the equipment may furthermore be transported as a unit before pressure treatment of the load. This has the advantage that the equipment may be assembled into a unit in advance, and that the unit results in a more convenient transport of the equipment to the site of the high-pressure press.

According to an embodiment of the present invention, the transportation unit may comprise a lifting arrangement provided in the working space. The lifting arrangement comprises a lifting means for lifting the load, and at least one track in the working space for transporting the lifting means. The lifting arrangement, comprising the lifting means and the at least one track, is hereby configured to move and/or transport a load in the working space of the arrangement. The present embodiment is advantageous in that a load may be moved/transported in the working space in a relatively fast, efficiently and convenient manner. The lifting means may lift/lower a load from/into a storage space in the working space and lift/lower a load from/into the transportation unit below the partition plane before/after pressure treatment of the load. The lifting means according to the present invention provides the further advantage that an overhead crane is not needed, wherein overhead cranes may result in an unstable, oscillating (and thereby dangerous) transportation of the load. Moreover, the at least one track provides a high degree of stability and safety during the transportation of the load along the track.

According to an embodiment of the present invention, the at least one track of the transportation unit in the working space may be aligned with the at least one track of the transportation unit under the partition plane, such that the transportation unit is configured to transport a load in a vertical plane from the working space into a treatment position before pressure treatment of the load, and from the treatment position to the working space after pressure treatment of the load. In other words, the vertically separated tracks may be provided along the same horizontal direction (e.g. a x-direction in Cartesian coordinates). Hence, the transportation of a load from the working space to the high-pressure arrangement (and backwards) may be provided horizontally (e.g. in a x-direction) and vertically (e.g. in a z-direction) in the same, vertical plane. The present embodiment is advantageous in that the arrangement hereby provides a movement and/or transportation of the load which is more stable and safe compared to a movement of the load e.g. in both x and y directions, as a transportation of this kind may lead to an oscillating, swinging and/or rotating movement of the load According to an embodiment of the present invention, the partition plane may comprise at least one opening, and wherein the transportation unit is configured to transport a load from the working space through the at least one opening and into the treatment position before pressure treatment of the load, and to transport the load from the treatment position through the at least one opening to the working space after pressure treatment of the load. The present embodiment is advantageous in that the transportation unit may conveniently move/transport the load form the working space to the high-pressure arrangement (and backwards) through the opening of the partition plane. Furthermore, the opening, which may be adapted to the size of the load, may hereby provide a transport of a load through the partition plane while still providing a sufficient shielding (or at least striving to maximize the shielding effect) during load transportation.

According to an embodiment of the present invention, the arrangement may further comprise at least one lid for at least partially closing the at least one opening. The present embodiment is advantageous in that lid even further improves the shielding of the partition plane. Furthermore, by at least partially closing the at least one opening, the lid provides a surface of the working space which may be used for (temporary) storage, e.g. for one or more loads, equipment, etc.

According to an aspect of the present invention, there is provided an equipment unit for use in an arrangement according to any one of the preceding embodiments. The equipment unit comprises one or more of the group consisting of a pressure vessel for holding a load for isostatic pressure treatment, a power transformer unit, and compressor unit. The equipment unit is advantageous in that the auxiliary equipment for the load for isostatic treatment of the load may be provided as a unitary arrangement or integrated unit. This has the advantage that the equipment for the load may be assembled into a unit in advance, and one or more of the pieces of equipment may be pre-assembled and tested in advance. The integrated equipment unit provides the advantage of relatively short cable and tube connections, which is not achievable if the pieces of equipment are separated as common in the prior art. The unit further provides the advantages of an easily maintained unit and of a more convenient transport of the unit to the site of the high-pressure press.

According to an embodiment of the present invention, there is provided a control system comprising an arrangement according to any one of the preceding embodiments, and at least one controller for controlling the arrangement automatically. By "controller", it is here meant a controller unit, arrangement, device, or the like, which is able to control the arrangement automatically, i.e. without any manual operation. It will be appreciated that the controller may be configured to control at least one, and preferably all, of the movements, transportations and/or actions of the arrangement automatically. The present embodiment is advantageous in that the control system achieves an even more efficient, fast and convenient movement and/or transportation of the load into and out from the high-pressure arrangement. The controller may further be configured to operate according to a control algorithm (i.e. based on feedback) implemented in the controller, for an even more efficient load movement/transportation. An automated transportation of the load into a treatment position for isostatic pressure treatment of the load from a working space outside the high-pressure arrangement, and backwards, may lead to a cycle time as short as 10 minutes. Prior art arrangements may require a cycle time of 1 h, and may be even longer, dependent on the amount of manual operation.

According to an embodiment of the present invention, there is provided a pressure system, comprising an arrangement according to any one of the previous embodiments, a load for isostatic pressure treatment, and a force-absorbing press frame for isostatic pressure treatment of the load. By "load", it is here meant substantially any element(s), material(s), composition(s), powder(s), etc., which is (are) to be subjected to high-pressure treatment. The present embodiment is advantageous in that the pressure system provides an efficient, robust and safe high-pressure treatment of a load, as it comprises the highly advantageous arrangement, the load to be treated and the force-absorbing press frame for treatment of the load.

According to an embodiment of the present invention, the pressure system may further comprise the equipment unit according to a previous embodiment. The present embodiment is advantageous in that the pressure system may hereby provide the (auxiliary) equipment unit for the load in advance.

According to an embodiment of the present invention, the equipment unit of the pressure system may comprise a pressure vessel for holding the load for isostatic pressure treatment, and a lid for the pressure vessel. The pressure system may further comprise a lifting device configured to put the lid onto the pressure vessel before pressure treatment of the load, and configured to remove the lid from the pressure vessel after pressure treatment of the load. The present embodiment is advantageous in that the pressure system hereby conveniently puts the lid on the vessel after the load has been arranged into the pressure vessel, and before the load and the pressure vessel are transported into the high-pressure press. Analogously, the pressure system may hereby remove the lid from the pressure vessel after pressure treatment of the load, for a removal of the load from the pressure vessel.

According to an embodiment of the present invention, the pressure system may further comprise at least one controller for controlling the arrangement automatically. The controller may be configured to control at least one, and preferably all, of the movements, transportations and/or actions of the arrangement automatically. The present embodiment is advantageous in that the controller is able to achieve an even more efficient, faster and more convenient movement and/or transportation of the load into and out from the high-pressure arrangement in the pressure system.

According to an embodiment of the second aspect of the invention, the method may further comprise the step of transporting an equipment unit on the at least one track, wherein the equipment unit comprises one or more of the group consisting of a pressure vessel, a power transformer, and a compressor. The present embodiment is advantageous in that an equipment unit, which may be relatively large, may be transported on the at least one track. Such a transport may be difficult or even impossible in prior art arrangements wherein a cavity or pit is provided for the high-pressure arrangement, as little or no space available for load-associated equipment. The method is further advantageous in that it is able to provide a transportation of the equipment as a unitary arrangement or unit, thereby avoiding a requirement to provide pre-installed equipment at the site of the high-pressure arrangement.

According to an embodiment of the second aspect of the invention, at least one step of the method, and preferably all steps of the method, are controlled automatically. The present embodiment is advantageous in that the automatic (i.e. non-manual) control is able to achieve an even more efficient, fast and convenient movement and/or transportation of the load into and out from the high-pressure arrangement.

It will be appreciated that the specific embodiments and any additional features described above with reference to the arrangement are likewise applicable and combinable with the method according to the second aspect of the present invention.

Further objectives of, features of, and advantages with, the present invention will become apparent when studying the following detailed disclosure, the drawings and the appended claims. Those skilled in the art will realize that different features of the present invention can be combined to create embodiments other than those described in the following.

BRIEF DESCRIPTION OF THE DRAWINGS

The present invention will now be described in more detail, with reference to the appended drawings showing a currently preferred embodiment of the invention, wherein.

DETAILED DESCRIPTION

In the following description, the present invention is described with reference to an arrangement for handling a load for isostatic pressure treatment in a high-pressure arrangement.

Figure 1:
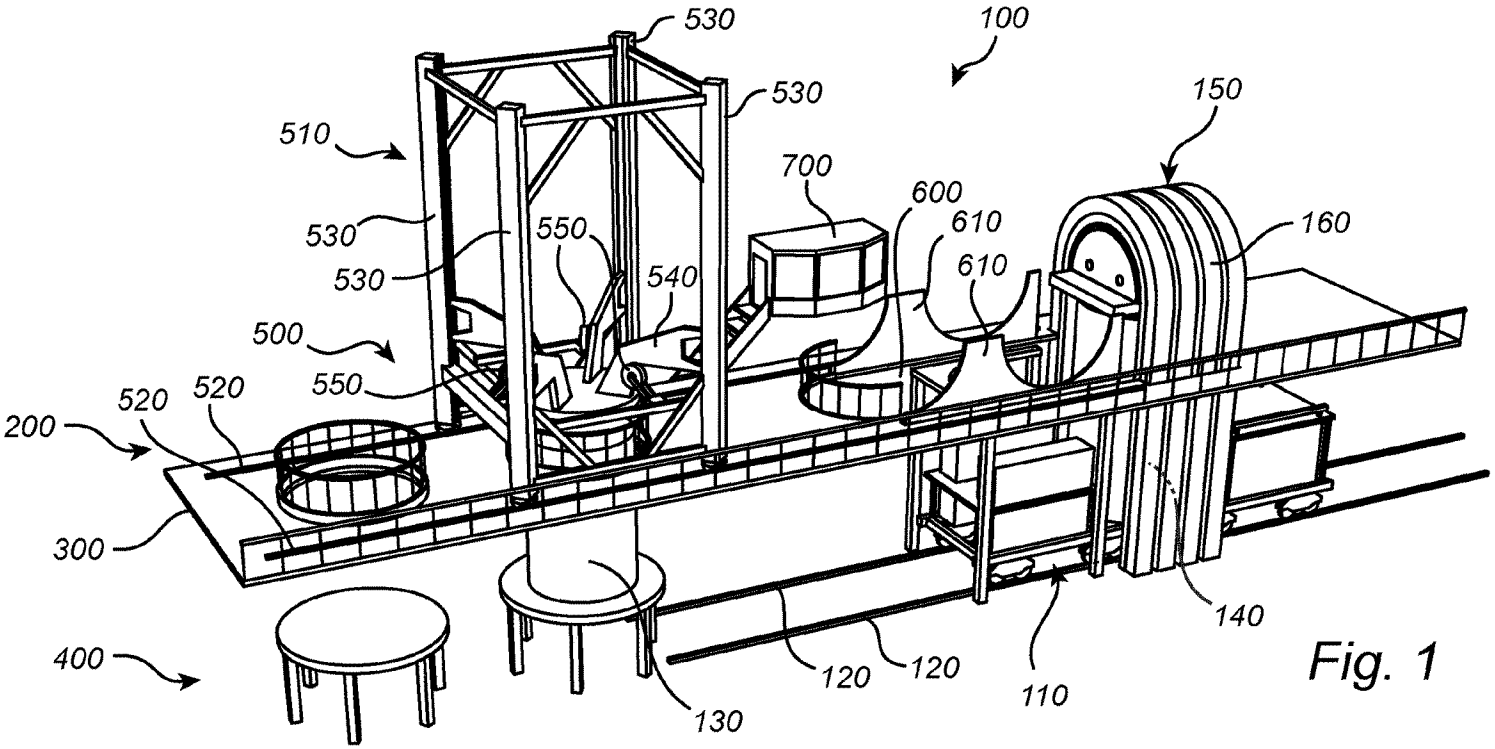
FIGS. 1-3 are schematic illustrations of an arrangement for handling a load for isostatic pressure treatment in a high-pressure arrangement.

FIG. 1 is a schematic illustration of an arrangement 100 comprising a transportation unit 110. The transportation unit 110 comprises at least one track 120, which is exemplified as a single, linear track 120 comprising two parallel rails arranged on a ground floor. The transportation unit 110 with the at least one track 120 is arranged to transport a load 130. The load 130, which is shown in FIG. 1 as a cylinder, may comprise element(s), material(s), composition(s), powder(s), etc., which is (are) to be subjected to high-pressure treatment.

The transportation unit 110 is arranged to transport the load 130 from a working space 200 outside a high-pressure arrangement 150, and to transport the load 130 into a treatment position 140 for isostatic pressure treatment of the load 130. The treatment position 140 is shown as a position within the high-pressure arrangement 150, wherein the high-pressure arrangement 150 in FIG. 1 comprises a force-absorbing press frame 160. The transportation unit 110 is further arranged to transport the load 130 from the treatment position 140 to the working space 200 after pressure treatment of the load 130.

The arrangement 100 comprises a partition plane 300 arranged at least partially above the high-pressure arrangement 150. The partition plane 300 is shown as a substantially horizontal plane or floor which at least partially separates the working space 200 from the high-pressure arrangement 150. It will be appreciated that the relation between the partition plane 300 and the high-pressure arrangement 150 in FIG. 1 is shown as an example, wherein the partition plane 300 is arranged above the treatment position 140 of the high-pressure arrangement 150, and wherein a top portion of the force-absorbing press frame 160 is arranged above the partition plane 300. It will be appreciated that the partition plane 300 defines the working space 200 above the partition plane 300, i.e. an upper floor above the partition plane 300. The working space 200 is arranged for the (first) step of transportation of the load 130 before pressure treatment, i.e. the transportation of the load 130 from the working space 200 outside the high-pressure arrangement 150. It will be appreciated that the working space 200 is arranged for any kind of manual and/or automatic production operation, e.g. the handling of the load 130. Furthermore, the partition plane 300 defines a space 400 below the partition plane 300, i.e. a lower floor below the partition plane 300. The space 400 is arranged for the (second) step of transportation of the load 130 before pressure treatment, i.e. the transportation of the load 130 into the treatment position 140 of the high-pressure arrangement 150 for isostatic pressure treatment of the load 130. It will be appreciated that the space 400 is further arranged for any kind of maintenance operation. The arrangement 100 may further comprise vertical walls, partitions, or the like, extending from the partition plane 300 to the lower floor, for enclosing the high-pressure arrangement 150. The arrangement 100 may further comprise a safety arrangement in the space 400, comprising one or more oxygen detectors and/or a fan system for an even safer operation of the arrangement 100.

The force-absorbing press frame 160 may be arranged on the lower (ground) floor, and it will be appreciated that heavy operations related to the force-absorbing press frame 160 may be performed on the lower floor. Furthermore, the wire of the force-absorbing press frame 160 may be wound on the lower floor. Moreover, a gantry crane may be temporarily used for the installation of the force-absorbing press frame 160, wherein each frame may weigh 200 tons.

The partition plane 300 is further arranged to shield the working space 200 from the high-pressure arrangement 150 in the event of a gas leakage of the high-pressure arrangement 150. Hence, the partition plane 300 may be constructed from any kind of material which is gas impermeable and which further may be able to support a relatively heavy load 130, equipment, etc.

The transportation unit 110 further comprises a lifting arrangement 500 provided in the working space 200. The lifting arrangement 500 comprises a lifting means 510 for lifting the load 130, wherein the lifting means 510 comprises a structure configured to lift the load into a center position of the lifting means 510. More specifically, the lifting means 510 comprises four vertical bars 530 wherein each bar 530 comprises a lifting device 540 arranged to hook a top portion of the load 130. Each bar 530 further comprises at least one wheel 550 for a stabilisation of the load 130 during lifting and/or transportation of the load 130. The stabilization of the load 130 is of high importance, as the load 130 may weigh 175 tons.

The transportation unit 110 further comprises at least one track 520 in the working space 200 for transporting the lifting means 510. The at least one track 520 is shown as a single, linear track 520 comprising two parallel rails arranged on the partition plane 300. The bottom ends of the bars 530 of the lifting means 510 may comprise rolling means (not shown) for a transportation on the at least one track 520.

The working space 200 of the arrangement 100 comprises a storage area for the at least one load 130. Here, the storage area is disclosed to comprise two openings in the partition plane 300, into which opening a cylinder-shaped load 130 may be stored before or after pressure treatment of the load 130. The at least one load 130 may alternatively be stored in an area to the left of the at least one track 520 in the working space 200.

The at least one track 520 of the transportation unit 110 in the working space 200 is aligned with the at least one track 120 of the transportation unit under the partition plane 300. Hence, the transportation unit 110 is configured to transport a load 130 in a vertical plane in the working space 200, parallel to the at least one track 520 in the working space 200. Furthermore, the transportation unit 110 is configured to transport the load 130 downwards, below the partition plane 300. Then, the transportation unit 110 is configured to transport the load 130 into the treatment position 140 on the at least one track 120 before pressure treatment of the load 130. After pressure treatment of the load 130, the transportation unit 110 is configured to transport the load 130 from the treatment position 140 back to the working space 200 along the same vertical plane.

The partition plane 300 comprises at least one opening 600, and the transportation unit 110 is configured to transport a load 130 from the working space 200 through the at least one opening 600 and into the treatment position 140 before pressure treatment of the load 130. Analogously, the transportation unit 110 is configured to transport the load 130 from the treatment position 140 through the at least one opening 600 to the working space 200 after pressure treatment of the load 130. The arrangement 100 further comprises at least one lid 610 for at least partially closing the at least one opening 600. Here, the lid 610 is provided as two flap portions arranged on opposite sides of the at least one opening 600. The flap portions of the lid 610 are provided with half-circular cut-outs, such that the lid 610 after closure allows a accommodation of a cylinder shaped load 130 and/or pressure vessel through the partition plane 300.

The arrangement 100 may further comprise at least one controller (not shown) for controlling the arrangement automatically. The automatic, i.e. non-manual, operation of one or more of the movements, operations and/or actions of the arrangement 100 may be controlled and/or monitored by an operator from a control room 700.

The arrangement 100 may further comprises a lifting device (not shown) configured to put a lid onto a pressure vessel before pressure treatment of the load 130, and configured to remove the lid from the pressure vessel after pressure treatment of the load 130.

It will be appreciated that the time needed for transporting the load into a treatment position for isostatic pressure treatment of the load from a working space outside the high-pressure arrangement, and backwards, may be as short as 10 minutes. Prior art arrangements may require a cycle time of 1 h, and may be even longer dependent on the amount of manual operation.

Figure 2:
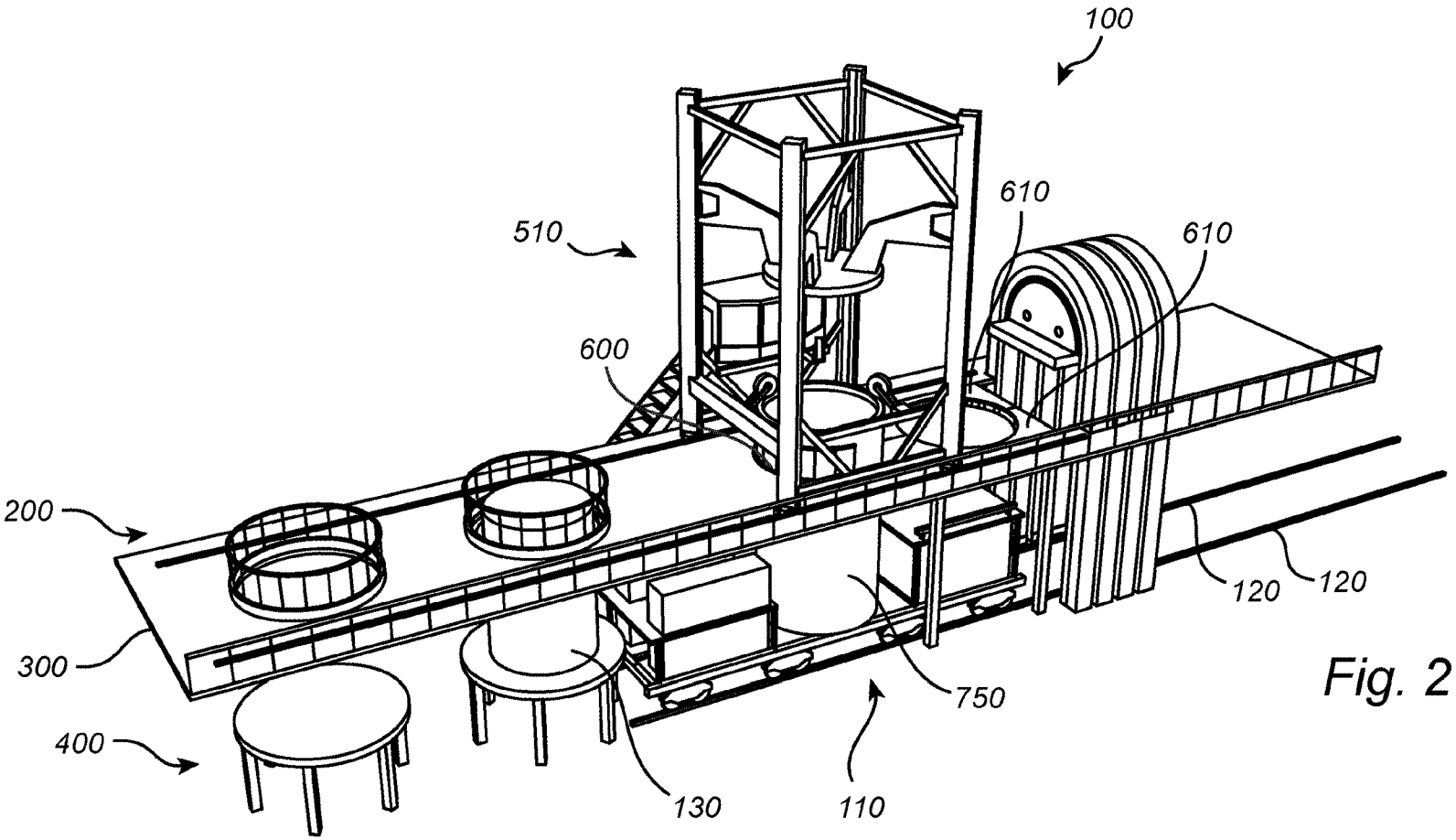

FIG. 2 shows a further schematic illustration of the arrangement 100. Here, the transportation unit 110 of the arrangement 100 has transported the load 130 from the working space 200 outside the high-pressure arrangement, and into the space 400 below the working space 200. Here, FIG. 2 shows the arrangement 100 before the transportation unit 110 is about to transport the load 130 into the treatment position for isostatic pressure treatment of the load 130. It will be appreciated that the load 130 has been inserted into a pressure vessel 750 by the lifting means 510. Furthermore, the lifting means 510 has arranged an isolation mantel (not shown) into the pressure vessel 750. The lid 610 is shown in a closed position, but is arranged to open before entry of the load 130 into the treatment position.

Figure 3:
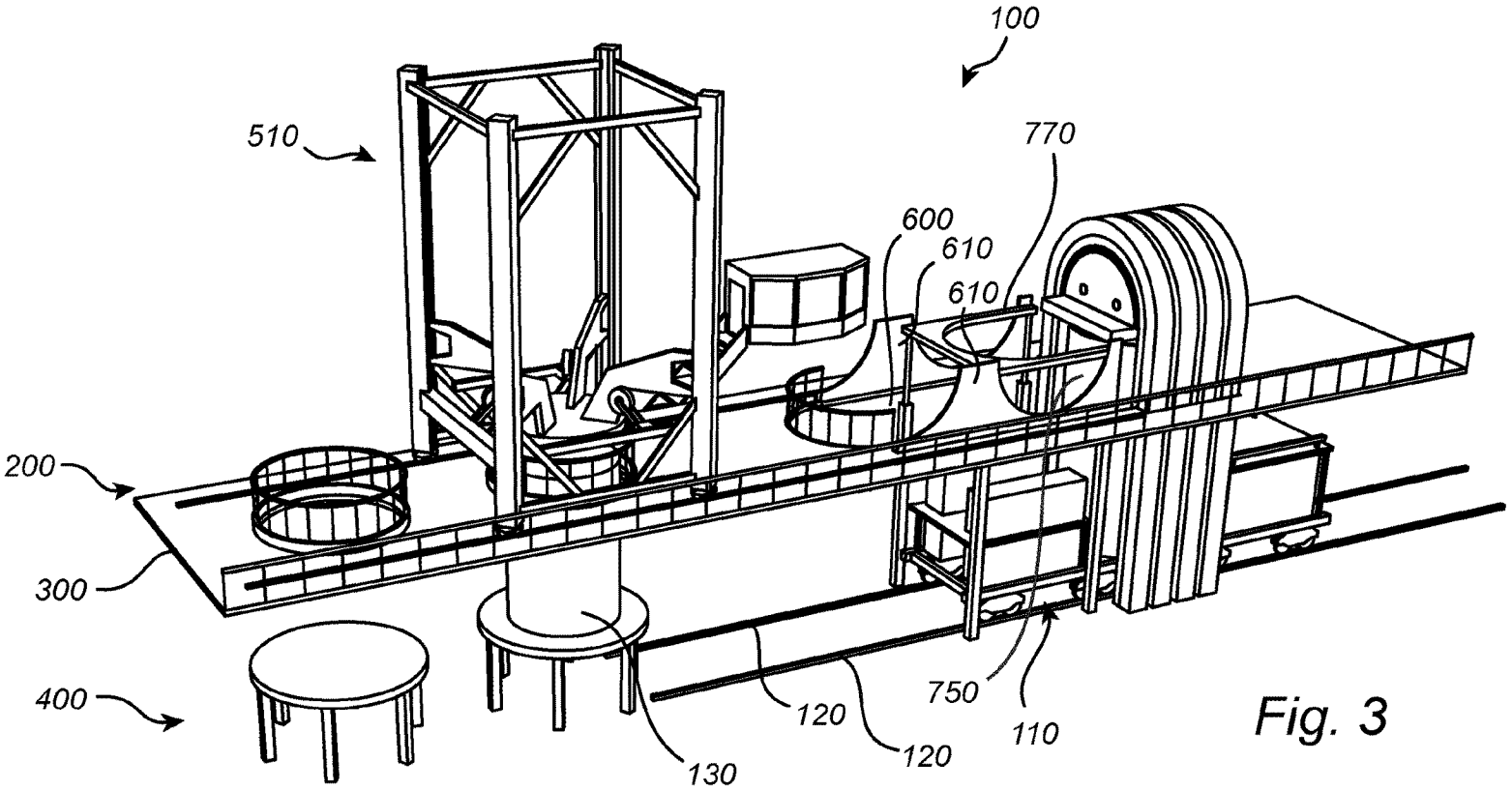

FIG. 3 shows yet another schematic illustration of the arrangement 100. Here, the transportation unit 110 of the arrangement 100 has transported the load 130 from the working space 200 outside the high-pressure arrangement, into the space 400 below the working space 200, and further into the treatment position for isostatic pressure treatment of the load 130, wherein the load is arranged within the pressure vessel 750. The lid 610 is shown in the open position. The lifting device 770 is configured to put a lid onto the pressure vessel 750 before pressure treatment of the load 130 in the pressure vessel 750.

Figure 4:
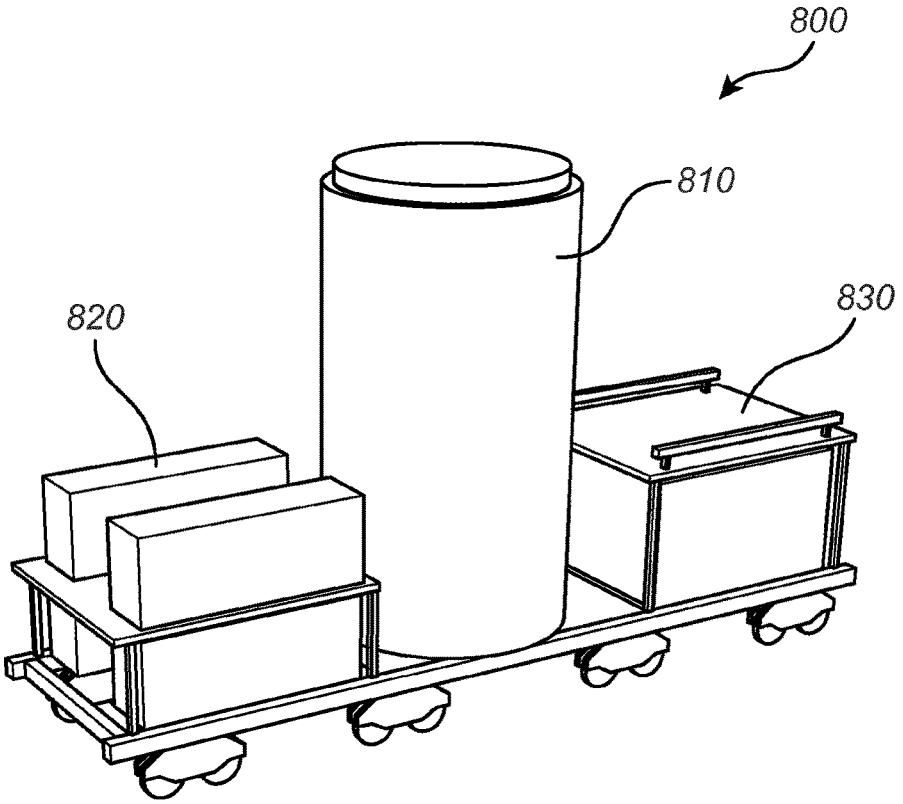
FIG. 4 is a schematic illustration of an equipment unit.

FIG. 4 discloses an equipment unit 800 (a pressure supply unit) for use in an arrangement 100 according to any one of the preceding embodiments. The equipment unit 800 comprises a pressure vessel 810 for holding a load 130 for isostatic pressure treatment, a power transformer unit 820, and compressor unit 830. The pressure vessel 810 may have a relatively large diameter of over 3.0 m, and the pressure vessel 810 may have a diameter of 3.14 m and a height of 5.0 m. Compared to a HIP system of the nearest size, which is 2.05 m in diameter and 4.2 m high, the first mentioned pressure vessel 810 has a volume which is 2.8 times larger. Furthermore, the weight of the pressure cylinder 810 may be 158 tons. The relatively large HIP system contributes to a relatively inexpensive cost below 0.15 $ per kg material.

The unitary arrangement or integrated unit of the equipment unit 800 may be pre-assembled (i.e. assembled in advance) and also be tested in advance. The integrated equipment unit 800 comprises only relatively short cables and tube connections (not shown). The compressor unit 830 comprises a lower, first level for housing a motor room, wherein the motor room preferably is sound insulated. The compressor unit 830 further comprises a second, upper level for a high pressure system (not shown). The compressor 830 and/or the power transformer unit 820 also include a water and electricity supply, and control functions for the operation of the compressor 830 and/or the power transformer unit 820 are installed.

Even though the invention has been described with reference to specific exemplifying embodiments thereof, many different alterations, modifications and the like will become apparent for those skilled in the art. The described embodiments are therefore not intended to limit the scope of the invention, as defined by the appended claims. For example, any sizes and/or number of units, devices or the like may be different than those described.

The invention claimed is:

1. An arrangement for handling a load for isostatic pressure treatment in a high-pressure arrangement, comprising:

a horizontal partition plane including at least one opening and being arranged at least partially above the high-pressure arrangement, the partition plane defining a working space outside the high-pressure arrangement and at least partially separating the working space from the high-pressure arrangement, wherein the working space is provided above the partition plane and wherein the partition plane is arranged to shield the working space from the high-pressure arrangement in the event of a gas leakage of the high-pressure arrangement; and a transportation unit including a lifting arrangement provided in the working space, wherein the lifting arrangement includes a lifting device to lift the load and at least one track in the working space for transporting the lifting device, wherein the arrangement is configured to transport the load in the working space on the at least one track and to transport the load through the at least one opening of the partition plane, and at least one track under the partition plane for transporting the load into a treatment position, wherein the at least one track in the working space is aligned with the at least one track under the partition plane, and wherein the transportation unit is configured to transport the load in a vertical plane from the working space into a treatment position before pressure treatment of the load, and from the treatment position to the working space after pressure treatment of the load.

2. The arrangement according to claim 1, wherein the transportation unit is configured to transport an equipment unit on the at least one track, wherein the equipment unit comprises one or more of the group consisting of a pressure vessel for holding a load for isostatic pressure treatment, a power transformer unit, and a compressor unit.

3. The arrangement according to claim 2, further comprising at least one lid for at least partially closing the at least one opening.

4. A control system, comprising the arrangement according to claim 2, and at least one controller for controlling the arrangement automatically.

5. A pressure system, comprising the arrangement according to claim 2, a load for isostatic pressure treatment, and a force-absorbing press frame for isostatic pressure treatment of the load.

6. The arrangement according to claim 1, further comprising at least one lid for at least partially closing the at least one opening.

7. A control system, comprising the arrangement according to claim 6, and at least one controller for controlling the arrangement automatically.

8. A pressure system, comprising the arrangement according to claim 6, a load for isostatic pressure treatment, and a force-absorbing press frame for isostatic pressure treatment of the load.

9. A control system, comprising the arrangement according to claim 1, and at least one controller for controlling the arrangement automatically.

10. A pressure system, comprising the arrangement according to claim 1, a load for isostatic pressure treatment, and a force-absorbing press frame for isostatic pressure treatment of the load.

11. The pressure system according to claim 10, further comprising an-equipment unit for use in the arrangement, wherein the equipment unit comprises one or more of the group consisting of a pressure vessel for holding a load for isostatic pressure treatment, a power transformer unit, and a compressor unit.

12. The pressure system according to claim 11, wherein the equipment unit comprises a pressure vessel for holding the load for isostatic pressure treatment and a lid for the pressure vessel, wherein the pressure system further comprises a lifting device configured to put the lid onto the pressure vessel before pressure treatment of the load, and configured to remove the lid from the pressure vessel after pressure treatment of the load.

13. The pressure system according to claim 10, further comprising at least one controller for controlling the arrangement automatically.

14. A method for handling a load for isostatic pressure treatment in a high-pressure arrangement, wherein the method comprises the steps of:

providing a horizontal partition plane comprising at least one opening and being arranged at least partially above the high-pressure arrangement, the partition plane defining a working space outside the high-pressure arrangement and at least partially separating the working space from the high-pressure arrangement, wherein the working space is provided above the partition plane, transporting a load in the working space on at least one track, transporting the load through the at least one opening of the partition plane, and transporting the load on at least one track under the partition plane into a treatment position, wherein the at least one track in the working space is aligned with the at least one track under the partition plane and wherein the load is transported in a vertical plane from the working space into a treatment position before pressure treatment of the load, and from the treatment position to the working space after pressure treatment of the load, and shielding the working space from the high pressure arrangement by means of the partition plane in the event of a gas leakage of the high pressure arrangement.

15. The method according to claim 14, further comprising the step of:

transporting an equipment unit on the at least one track, wherein the equipment unit comprises one or more of the group consisting of a pressure vessel, a power transformer, a compressor, and a pressure intensifier.

16. The method according to claim 15, wherein at least one step is controlled automatically.

17. The method according to claim 16, wherein all steps are controlled automatically.

18. The method according to claim 14, wherein at least one step is controlled automatically.

19. The method according to claim 18, wherein all steps are controlled automatically.

* * * * *